US007171979B1

(12) United States Patent
Lai

(10) Patent No.: US 7,171,979 B1
(45) Date of Patent: Feb. 6, 2007

(54) DRINKING WATER FOUNTAIN HAVING A CONTROL VALVE SEAT THAT IS POSITIONED EASILY

(75) Inventor: Cheng-Fu Lai, Lukang Cheng (TW)

(73) Assignee: Yea Leng Co., Ltd., Changhwa (TW)

( * ) Notice: Subject to any disclaimer, the term of this patent is extended or adjusted under 35 U.S.C. 154(b) by 313 days.

(21) Appl. No.: 10/866,960

(22) Filed: Jun. 14, 2004

(51) Int. Cl.
*F16K 21/00* (2006.01)

(52) U.S. Cl. ..... 137/359; 137/801; 4/675

(58) Field of Classification Search ..... 137/15.01, 137/359, 801; 4/675
See application file for complete search history.

(56) References Cited

U.S. PATENT DOCUMENTS 4,671,316 A * 6/1987 Botnick ..... 137/359
4,760,861 A * 8/1988 Botnick ..... 137/15.01
4,998,555 A * 3/1991 Barhydt et al. ..... 137/359
5,010,922 A * 4/1991 Agresta ..... 137/359
5,014,749 A * 5/1991 Humpert et al. ..... 137/801

* cited by examiner

*Primary Examiner*—A. Michael Chambers
(74) *Attorney, Agent, or Firm*—Alan D. Kamrath; Nikolai & Mersereau, P.A.

(57) ABSTRACT

A drinking water fountain includes a control valve seat having an inside formed with a mounting hole, a screw member having a first end secured in the mounting hole of the control valve seat and a second end protruding outward from the mounting hole of the control valve seat, and a retractable positioning member pivotally mounted on the second end of the screw member. Thus, the control valve seat is mounted on the sink easily and conveniently, thereby facilitating a user mounting the drinking water fountain on the sink.

10 Claims, 6 Drawing Sheets

DRINKING WATER FOUNTAIN HAVING A CONTROL VALVE SEAT THAT IS POSITIONED EASILY

BACKGROUND OF THE INVENTION

1. Field of the Invention

The present invention relates to a drinking water fountain, and more particularly to a drinking water fountain having a control valve seat that is mounted and positioned easily and conveniently.

2. Description of the Related Art

A conventional drinking water fountain comprises a control valve seat mounted on the top of a sink, a threaded fitting tube fixed on the bottom of the control valve seat and extended through the sink, and a nut screwed onto the fitting tube and rested on the bottom of the sink to fix the control valve seat on the sink. Thus, the control valve seat is fixed on the sink by screwing the nut onto the fitting tube of the control valve seat. However, the control valve seat and the nut are located at the outside and the inside of the sink respectively, thereby causing inconvenience to a user to screw the nut onto the fitting tube of the control valve seat.

SUMMARY OF THE INVENTION

In accordance with the present invention, there is provided a drinking water fountain, comprising:

a control valve seat having an inside formed with a mounting hole;

a screw member mounted in the control valve seat and having a first end secured in the mounting hole of the control valve seat and a second end protruding outward from the mounting hole of the control valve seat; and a retractable positioning member pivotally mounted on the second end of the screw member.

The primary objective of the present invention is to provide a drinking water fountain having a control valve seat that is mounted and positioned easily and conveniently.

Another objective of the present invention is to provide a drinking water fountain, wherein the control valve seat is mounted on the sink easily and conveniently, thereby facilitating a user mounting the drinking water fountain on the sink.

A further objective of the present invention is to provide a drinking water fountain, wherein the positioning member is fixed on the bottom of the sink closely by rotation of the screw member, so that the control valve seat is mounted on sinks of different sizes and types, thereby enhancing the versatility of the drinking water fountain.

A further objective of the present invention is to provide a drinking water fountain, wherein the screw member is axially extended through the control valve seat, thereby facilitating the user adjusting and mounting the drinking water fountain on the sink.

Further benefits and advantages of the present invention will become apparent after a careful reading of the detailed description with appropriate reference to the accompanying drawings.

DETAILED DESCRIPTION OF THE INVENTION

Figure 1:
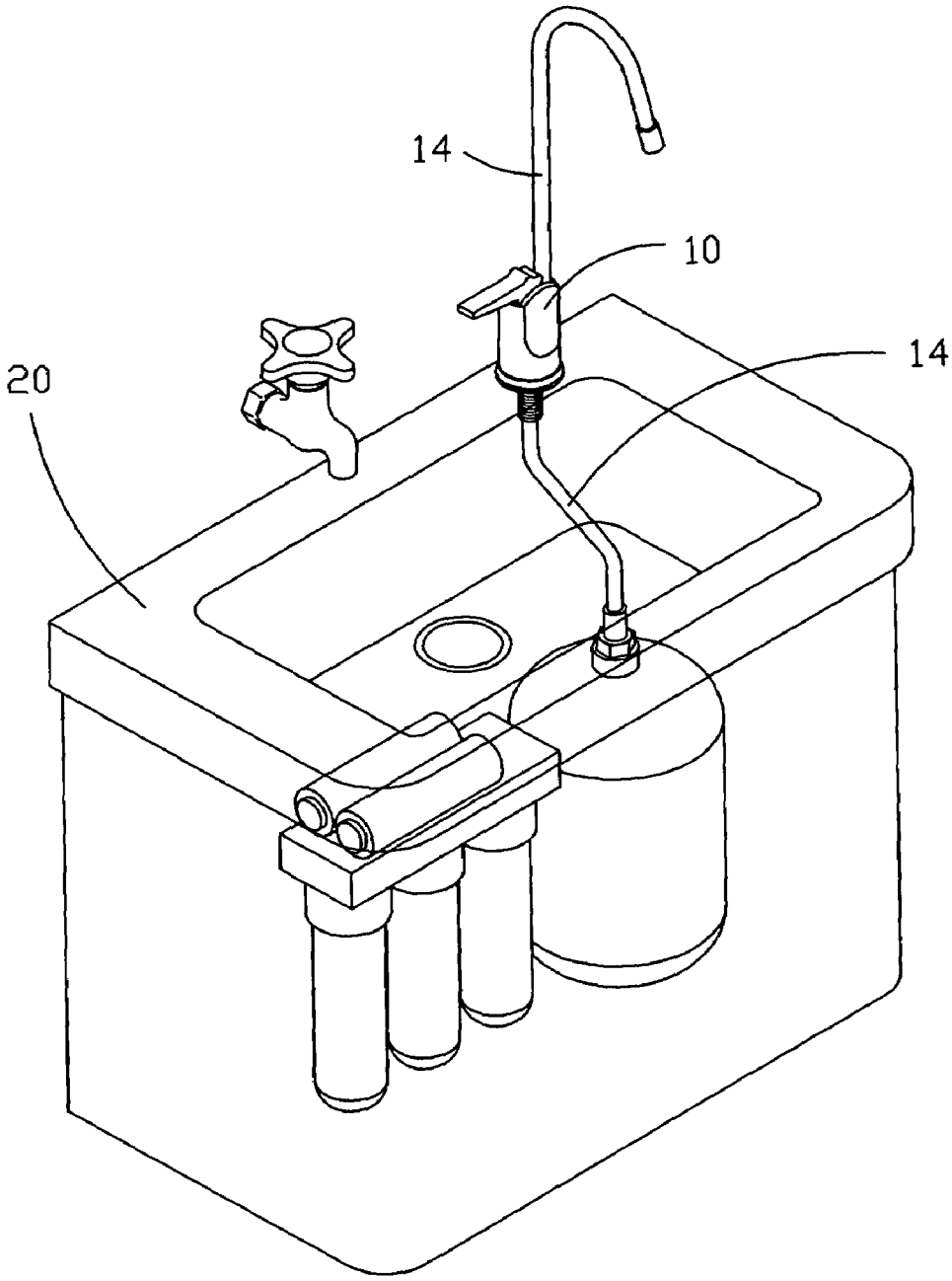
FIG. 1 is a perspective view of a drinking water fountain in accordance with the preferred embodiment of the present invention.

Referring to the drawings and initially to FIGS. 1–5, a drinking water fountain in accordance with the preferred embodiment of the present invention comprises a control valve seat 10 having an inside formed with a mounting hole 101, a screw member 12 mounted in the control valve seat 10 and having a first end secured in the mounting hole 101 of the control valve seat 10 and a second end protruding outward from the mounting hole 101 of the control valve seat 10, and a retractable positioning member 15 pivotally mounted on the second end of the screw member 12.

The mounting hole 101 of the control valve seat 10 has a stepped shape. The mounting hole 101 of the control valve seat 10 has a mediate portion formed with a stepped portion 102.

The screw member 12 is axially extended through the control valve seat 10. The first end of the screw member 12 is formed with an enlarged head 120 rested on the stepped portion 102 of the control valve seat 10 so that the first end of the screw member 12 is secured in the mounting hole 101 of the control valve seat 10. A sealing gasket 13 is mounted on the screw member 12 and urged between the enlarged head 120 of the screw member 12 and the stepped portion 102 of the control valve seat 10 to provide a sealing effect.

The positioning member 15 includes a pivot seat 152 mounted on the second end of the screw member 12, two substantially U-shaped locking plates 151 each pivotally mounted on the pivot seat 152, and a torsion spring 153 mounted on the pivot seat 152 and having two ends each urged on a respective one of the two locking plates 151.

The second end of the screw member 12 is formed with an outer thread 122, and the pivot seat 152 has an inside formed with an inner thread 1520 screwed onto the outer thread 122 of the screw member 12.

The drinking water fountain further comprises a water inlet tube 14 mounted on the control valve seat 10 by a connecting tube 16 to supply water into the control valve seat 10, and a water outlet tube 11 mounted on the control valve seat 10 to inject the water outward from the control valve seat 10. Preferably, the water outlet tube 11 has a lower end mounted in the mounting hole 101 of the control valve seat 10.

Figure 2:
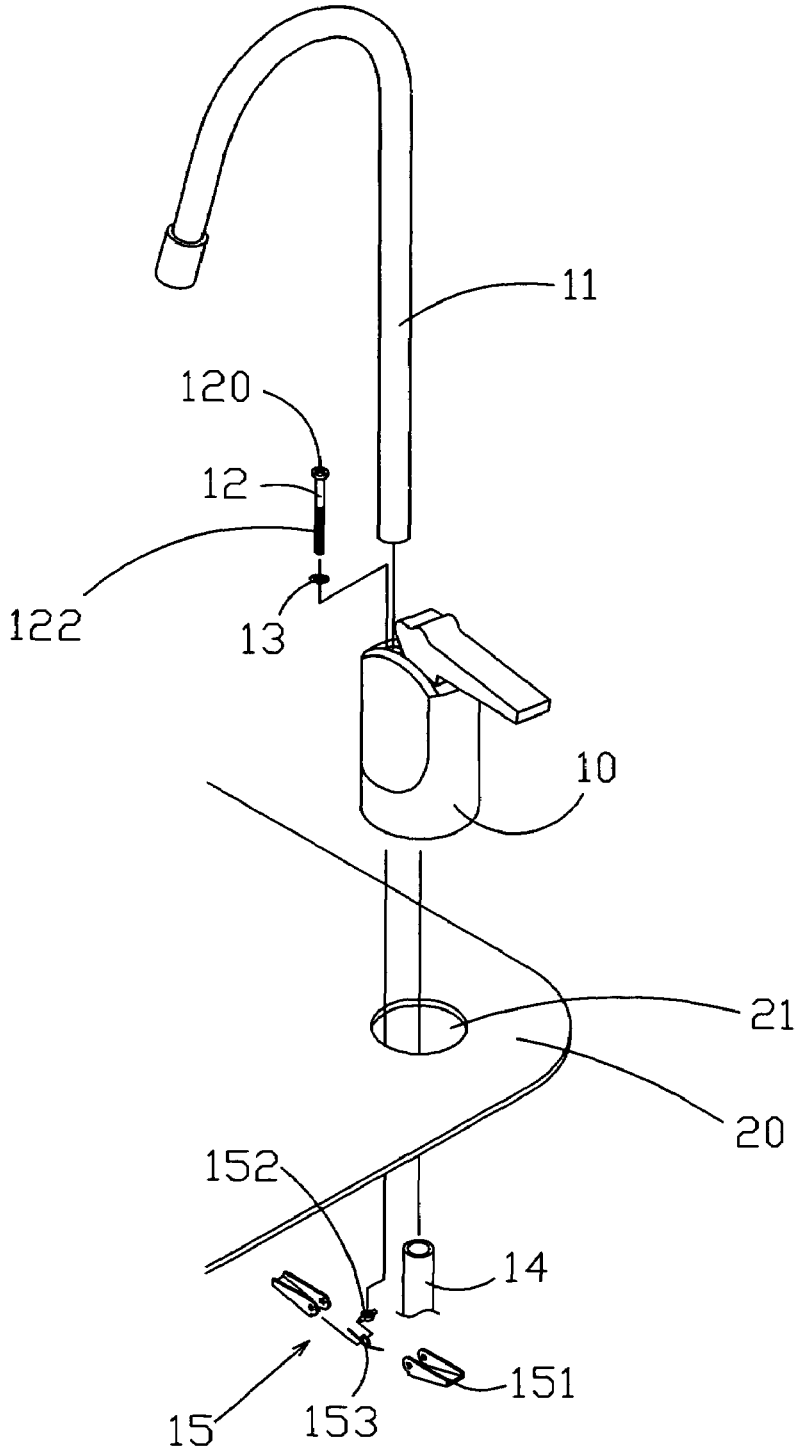
FIG. 2 is an exploded perspective view of the drinking water fountain in accordance with the preferred embodiment of the present invention.

In assembly, the control valve seat 10 is mounted on a sink 20 having a fitting hole 21 as shown in FIG. 2.

Figure 4:
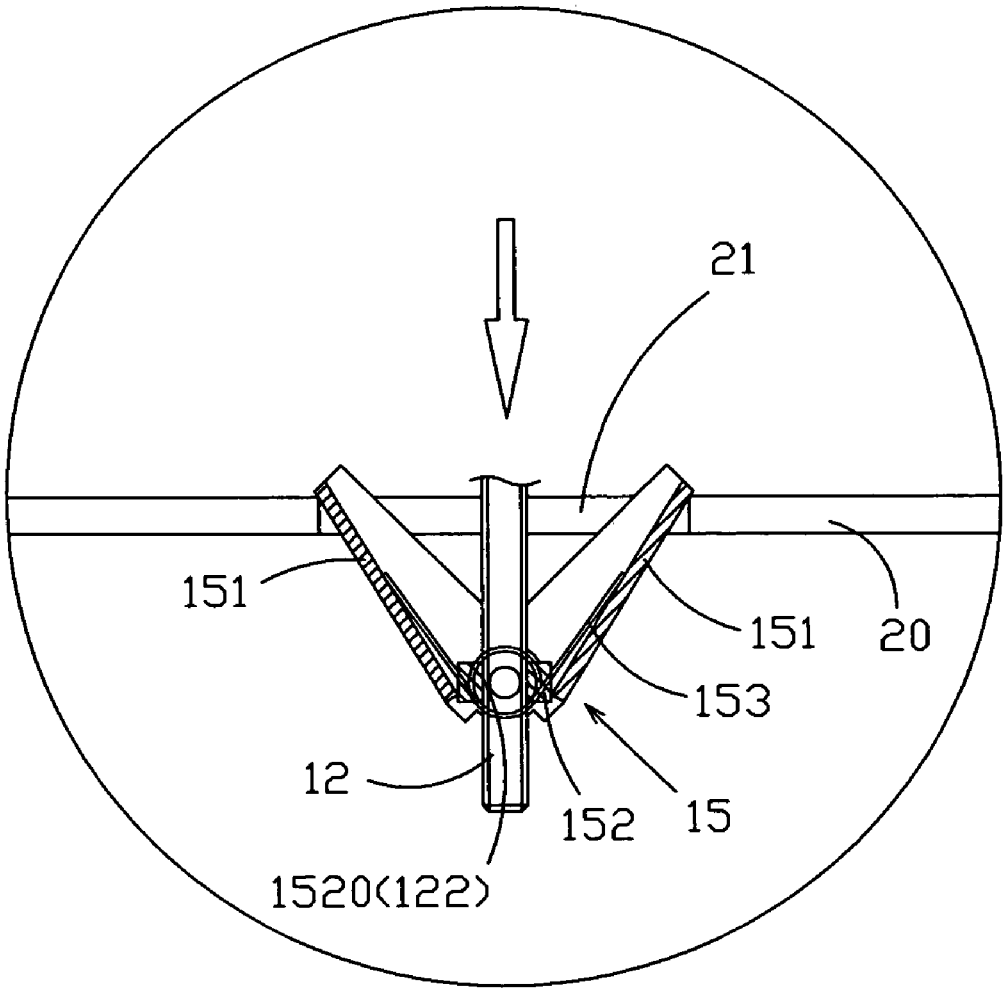
FIG. 4 is a schematic plan cross-sectional operational view of the drinking water fountain as shown in FIG. 2.

As shown in FIG. 4, when the positioning member 15 is moved downward to pass through the fitting hole 21 of the sink 20, the two locking plates 151 are pressed upward by the wall of the fitting hole 21 of the sink 20, so that the two locking plates 151 are pivoted upward about the pivot seat 152 to retract the positioning member 15, thereby allowing the whole positioning member 15 passing through the fitting hole 21 of the sink 20.

Figure 3:
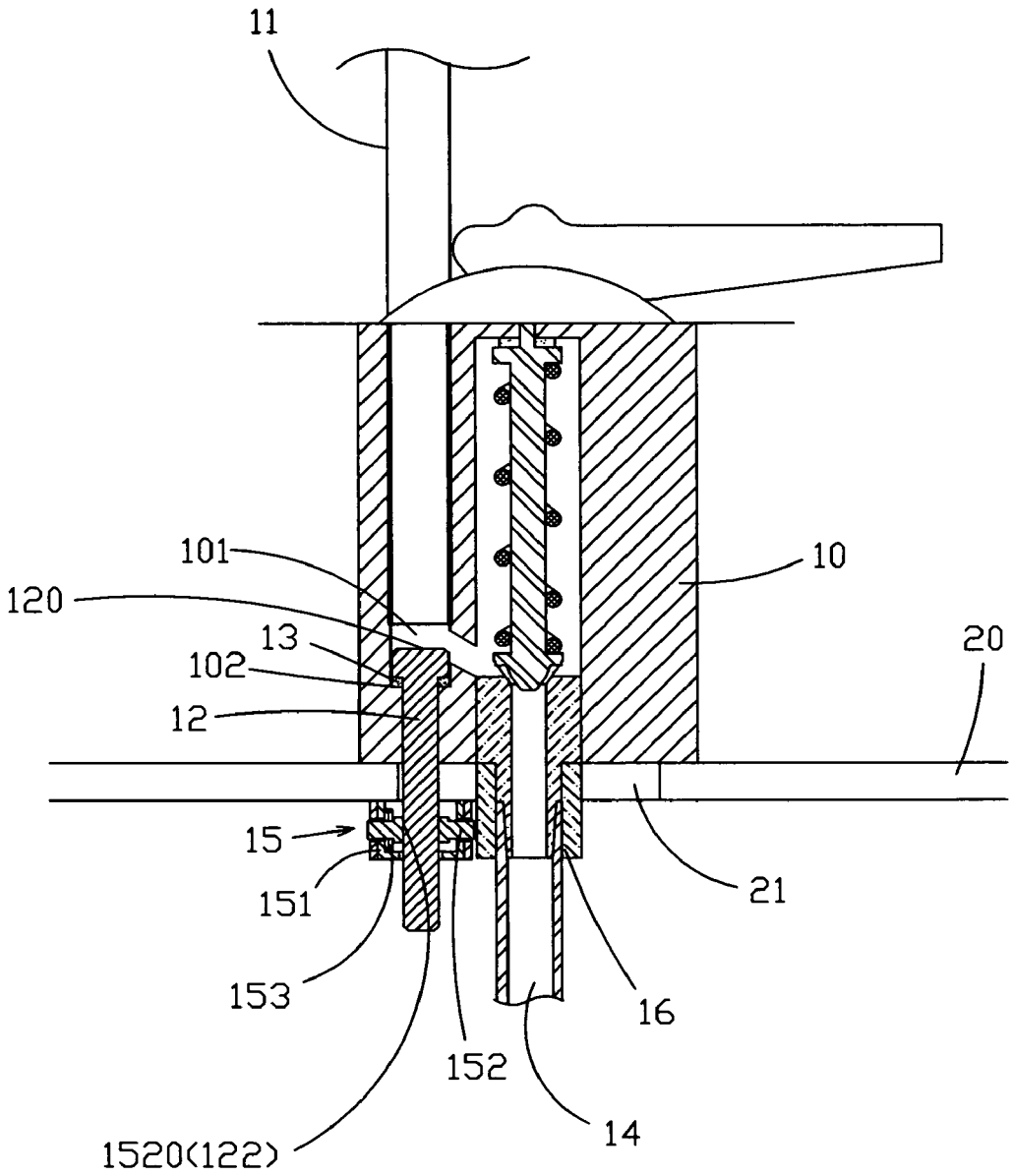
FIG. 3 is a partially plan cross-sectional assembly view of the drinking water fountain as shown in FIG. 2.
Figure 5:
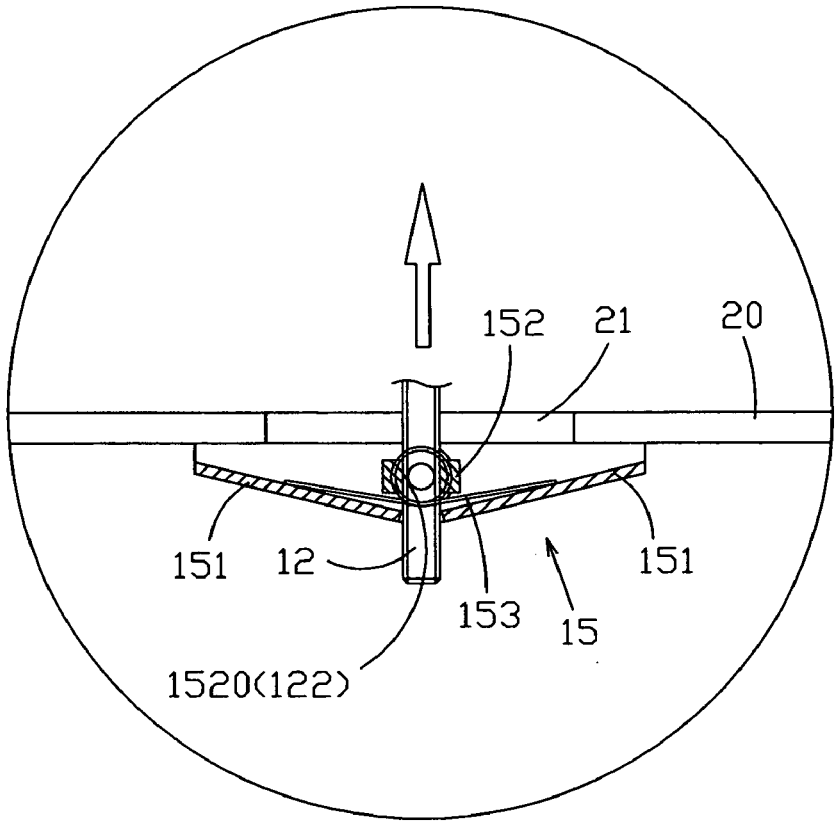
FIG. 5 is a schematic plan operational view of the drinking water fountain as shown in FIG. 4.

As shown in FIG. 5, after the positioning member 15 passes through the fitting hole 21 of the sink 20, the two locking plates 151 are pressed downward by the restoring force of the torsion spring 153, so that the two locking plates 151 are pivoted downward about the pivot seat 152 to expand the positioning member 15. Thus, the positioning member 15 is expanded to block the fitting hole 21 of the sink 20 and is rested on a bottom of the sink 20. Then, the screw member 12 is rotated to move the pivot seat 152 and the two locking plates 151 to press the bottom of the sink 20, so that the control valve seat 10 is positioned on the sink 20 by screwing the screw member 12 as shown in FIG. 3.

Figure 6:
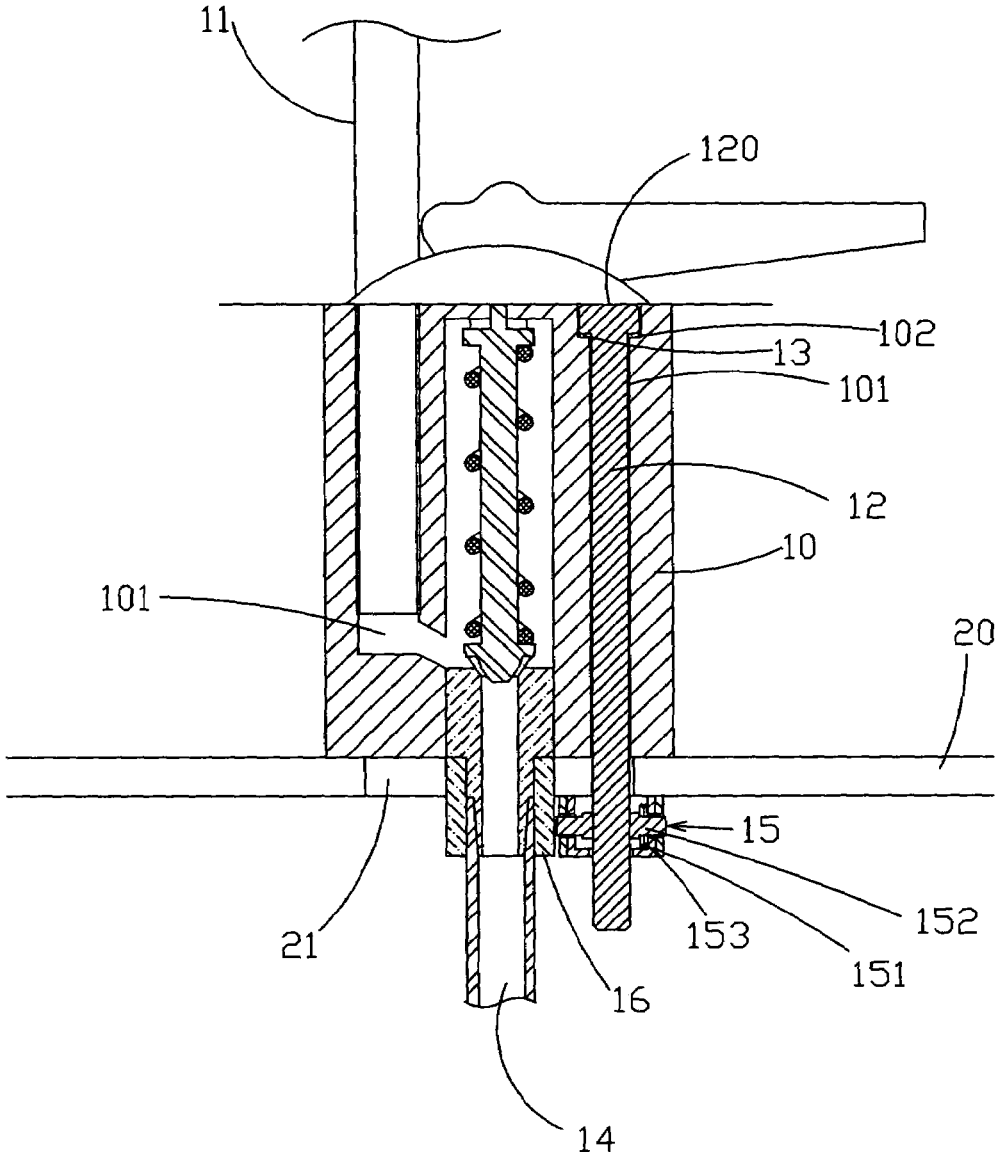
FIG. 6 is a another partially plan cross-sectional assembly view of the drinking water fountain as shown in FIG. 2.

Referring to FIG. 6, the mounting hole 101 of the control valve seat 10 has an upper end formed with the stepped portion 102.

Accordingly, the control valve seat 10 is mounted on the sink 20 easily and conveniently, thereby facilitating a user mounting the drinking water fountain on the sink 20. In addition, the positioning member 15 is fixed on the bottom of the sink 20 closely by rotation of the screw member 12, so that the control valve seat 10 is mounted on sinks of different sizes and types, thereby enhancing the versatility of the drinking water fountain. Further, the screw member 12 is axially extended through the control valve seat 10, thereby facilitating the user adjusting and mounting the drinking water fountain on the sink 20.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A drinking water fountain, comprising:

a control valve seat having an inside formed with a mounting hole;

a screw member mounted in the control valve seat and having a first end secured in the mounting hole of the control valve seat and a second end protruding outward from the mounting hole of the control valve seat; and a retractable positioning member pivotally mounted on the second end of the screw member;

wherein the mounting hole of the control valve seat is formed with a stepped portion, and the first end of the screw member is formed with an enlarged head rested on the stepped portion of the control valve seat so that the first end of the screw member is secured in the mounting hole of the control valve seat.

2. The drinking water fountain in accordance with claim 1, wherein the mounting hole of the control valve seat has a stepped shape.

3. The drinking water fountain in accordance with claim 1, wherein the stepped portion is formed on a mediate portion of the mounting hole of the control valve seat.

4. The drinking water fountain in accordance with claim 1, wherein the stepped portion is formed on an upper portion of the mounting hole of the control valve seat.

5. The drinking water fountain in accordance with claim 1, further comprising a sealing gasket mounted on the screw member and urged between the enlarged head of the screw member and the stepped portion of the control valve seat.

6. The drinking water fountain in accordance with claim 1, wherein the positioning member includes a pivot seat mounted on the second end of the screw member, two locking plates each pivotally mounted on the pivot seat, and a torsion spring mounted on the pivot seat and having two ends each urged on a respective one of the two locking plates.

7. The drinking water fountain in accordance with claim 6, wherein each of the two locking plates is substantially U-shaped.

8. The drinking water fountain in accordance with claim 6, wherein the second end of the screw member is formed with an outer thread, and the pivot seat has an inside formed with an inner thread screwed onto the outer thread of the screw member.

9. The drinking water fountain in accordance with claim 1, further comprising a water outlet tube having a lower end mounted in the mounting hole of the control valve seat.

10. The drinking water fountain in accordance with claim 1, wherein the screw member is axially extended through the control valve seat.

* * * * *